United States Patent [19]

Gearhart

[11] Patent Number: 4,739,568

[45] Date of Patent: Apr. 26, 1988

[54] SIGN CONSTRUCTION FOR PHOTOGRAPHIC TRANSPARENCIES

[75] Inventor: Jerrold J. Gearhart, Rochester, N.Y.

[73] Assignee: Spectacolor Inc., New York, N.Y.

[21] Appl. No.: 933,647

[22] Filed: Nov. 21, 1986

[51] Int. Cl.[4] ..... G09F 17/00

[52] U.S. Cl. ..... 40/603; 40/564; 40/624

[58] Field of Search ..... 40/152.2, 603, 578, 40/212, 624, 615, 610, 604, 214, 215; 206/829; 160/378; 350/117, 125; 156/304.1; 428/42

[56] References Cited

U.S. PATENT DOCUMENTS

| | | | |
|---|---|---|---|
| 2,637,132 | 5/1953 | Helms et al. | 40/152.2 |
| 3,934,365 | 1/1976 | Stein et al. | 40/603 |
| 3,977,111 | 8/1976 | Fritts | 40/564 |
| 3,998,522 | 12/1976 | Holzel | 350/125 |
| 4,022,522 | 5/1977 | Rain | 350/117 |
| 4,185,408 | 1/1980 | Tracy | 40/603 |
| 4,362,591 | 12/1982 | Tracy | 40/624 |
| 4,368,587 | 1/1983 | Childs | 40/615 |
| 4,372,071 | 2/1983 | Vicino | 40/603 |

*Primary Examiner*—Paul J. Hirsch
*Assistant Examiner*—Cary E. Stone
*Attorney, Agent, or Firm*—Blum Kaplan

[57] ABSTRACT

A sealed backlit sign frame having a photographic transparency as the viewing face of the frame is provided. Lights are provided behind the transparency for illumination. A partial vacuum or negative pressure is created in the frame and bows the transparency inwardly. This bowing action stabilizes the transparency and prevents wind induced undulations. Exhaust blowers and air vent dampers are provided to maintain the negative pressure in the frame. The blowers, dampers and lights are preferably controlled by a suitable control system.

44 Claims, 5 Drawing Sheets

FIG. 1
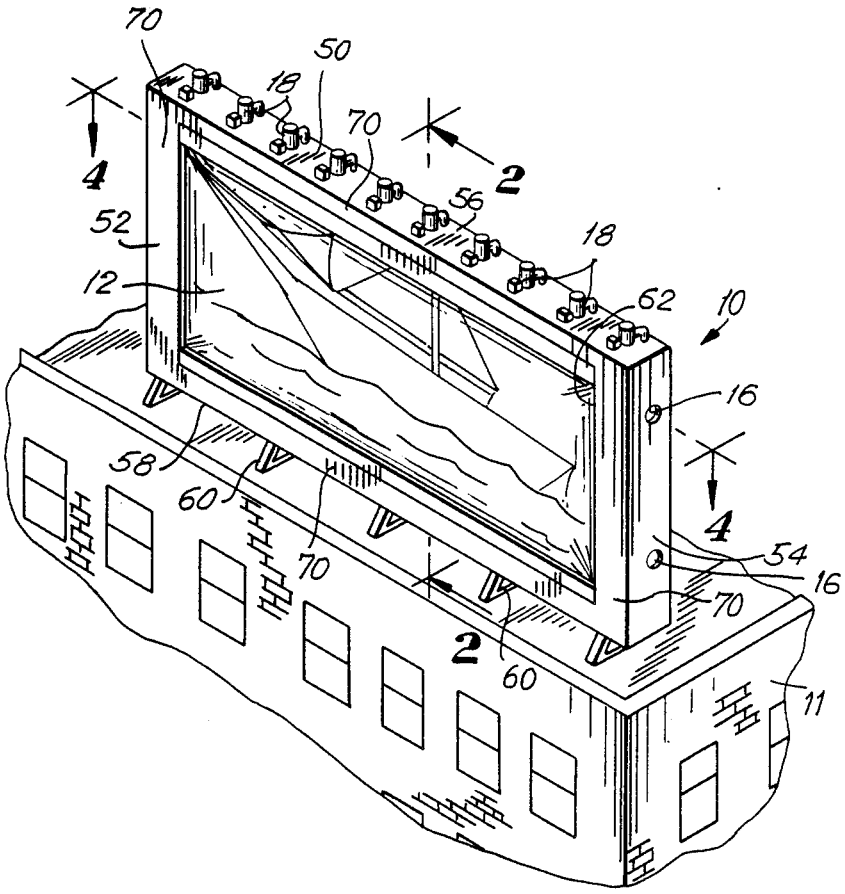
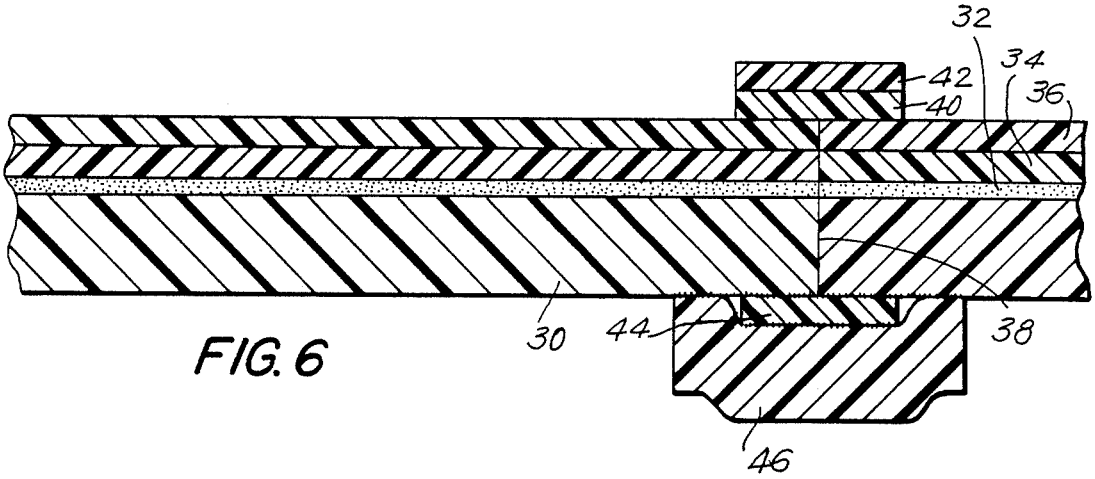
FIG. 6

SIGN CONSTRUCTION FOR PHOTOGRAPHIC TRANSPARENCIES

BACKGROUND OF THE INVENTION

This invention relates generally to outdoor sign constructions and, in particular, to a sign construction for outdoor photographic transparencies or other thin-walled rear-illuminated murals.

Large photographic transparencies for indoor use are known in the art. Such photographic transparencies are constructed by splicing large processed strips of film together to form a transparency of the desired size having a unitary oversized picture thereon. One exemplary large indoor color photographic transparency of this type is displayed above the main waiting room of Grand Central Station in New York City. The tranparency forms a large display surface which is illuminated from the rear to provide a beautiful picture.

However, use of a similar sign construction outdoors with a thin-walled transparency has so far proven impractical. Specifically, large transparencies undulate due to wind currents when displayed outdoors. The undulations become stronger and more frequent as wind velocity increases. Eventually, the undulations produced by high winds create stresses in the film and splices, stretch or otherwise deform the transparency and eventually destroy the integrity of the transparency. Supporting structures to prevent film undulation in outdoor installations have to date been impractical, costly and detrimental to the visual impact of a large backlit transparency.

Accordingly, it is desired to provide a sign construction that is practical for outdoor display of large rear-illuminated photographic transparencies or other thin-walled murals.

SUMMARY OF THE INVENTION

Generally speaking, in accordance with the present invention, a sign construction for supporting a thin-walled mural such as a photographic transparency is provided. The sign construction includes a frame having an open front which supports the mural around the periphery thereof to cover the open front of the frame. A pressure system creates a negative pressure behind the mural in the frame to protect the mural from damage caused by wind or the like.

In a preferred embodiment, a sealed backlit sign box or frame which supports a photographic transparency around the periphery thereof is provided. Appropriate lights are provided in the box behind the transparency for illuminating same. A partial vacuum or negative pressure is created in the box which tends to bow the transparency inward toward the rear of the frame. This bowing action stabilizes the transparency and substantially prevents wind-induced undulations. Exhaust blowers and air vent dampers are provided to assist in maintaining the negative pressure in the frame. The blowers, dampers and lights are controlled by a suitable control system.

It is, therefore, an object of the invention to provide a sign construction suitable for outdoor display of large backlit transparencies.

It is another object of the invention to provide a sign construction using a sign box or frame in which the transparency to be displayed forms the viewing face of the box.

It is a further object of the invention to provide means for displaying large outdoor photographic transparencies or other thin-walled murals which prevent damage to the transparency caused by wind or other environmental factors.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

DESCRIPTION OF THE DRAWINGS

For a fuller understanding of the invention, reference is had to the following description taken in connection with the accompanying drawings, in which:

FIG. 1 is a perspective view of an outdoor sign supporting a photographic transparency constructed and arranged in accordance with a preferred embodiment of the present invention, shown mounted on top of a building;

FIG. 6 is an enlarged side sectional view of a portion of a photographic transparency for use in the sign construction of the present invention shown at a splice.

DETAILED DESCRIPTION OF THE PREFERRED EMBODIMENTS

Figure 2:
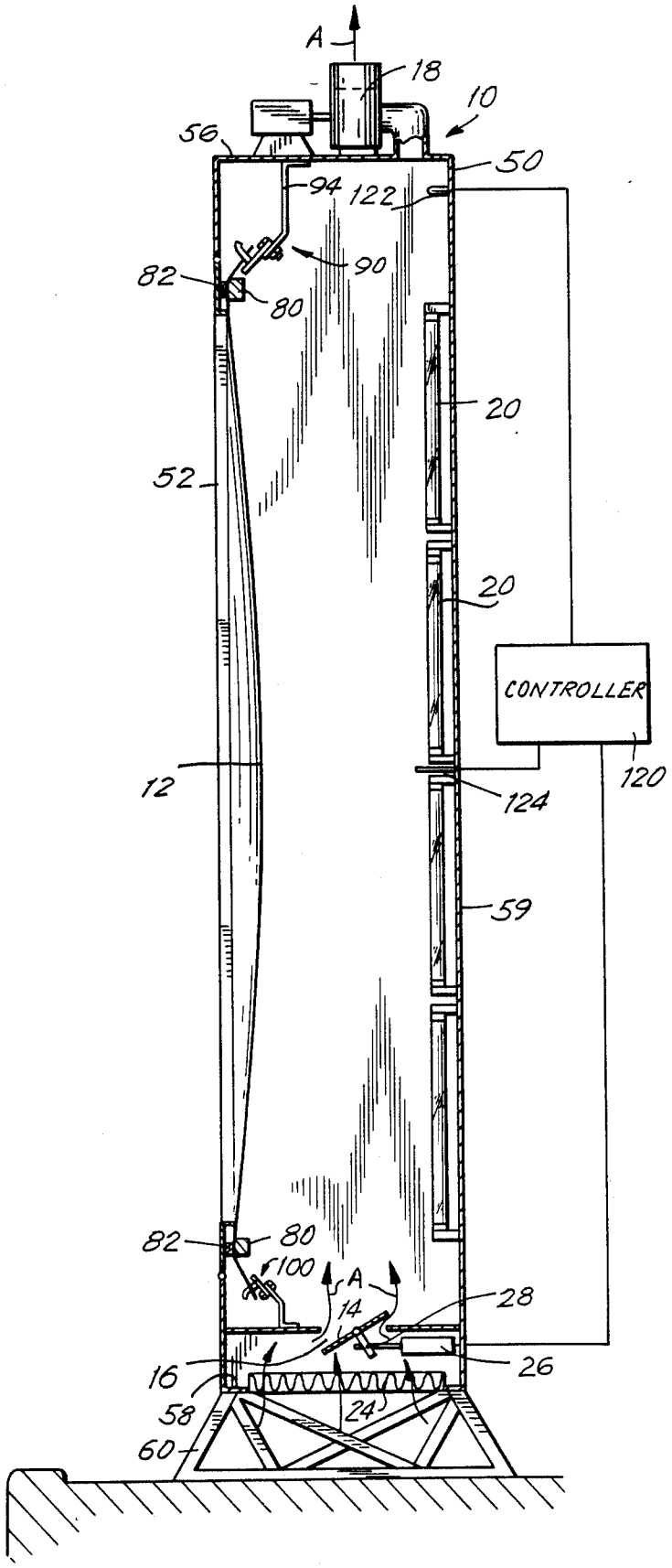
FIG. 2 is an enlarged sectional view taken along lines 2—2 of FIG. 1.

Reference is first made to FIG. 1 which depicts an outdoor sign, generally indicated at 10, constructed in accordance with a preferred embodiment of the present invention. Sign 10 is shown mounted on the roof of a building 11. Sign 10 includes a sign box or frame 50 which supports a thin-walled photographic transparency 12.

Referring now to FIGS. 2 through 5 in addition to FIG. 1, it is seen that sign frame 50 includes sides 52 and 54, a top 56, a bottom 58 and a back wall 59. Appropriate sign supporting members 60 anchor frame 50 to building 11. Front 62 of frame 50 is open to permit mounting of transparency 12 thereacross.

Figure 4:
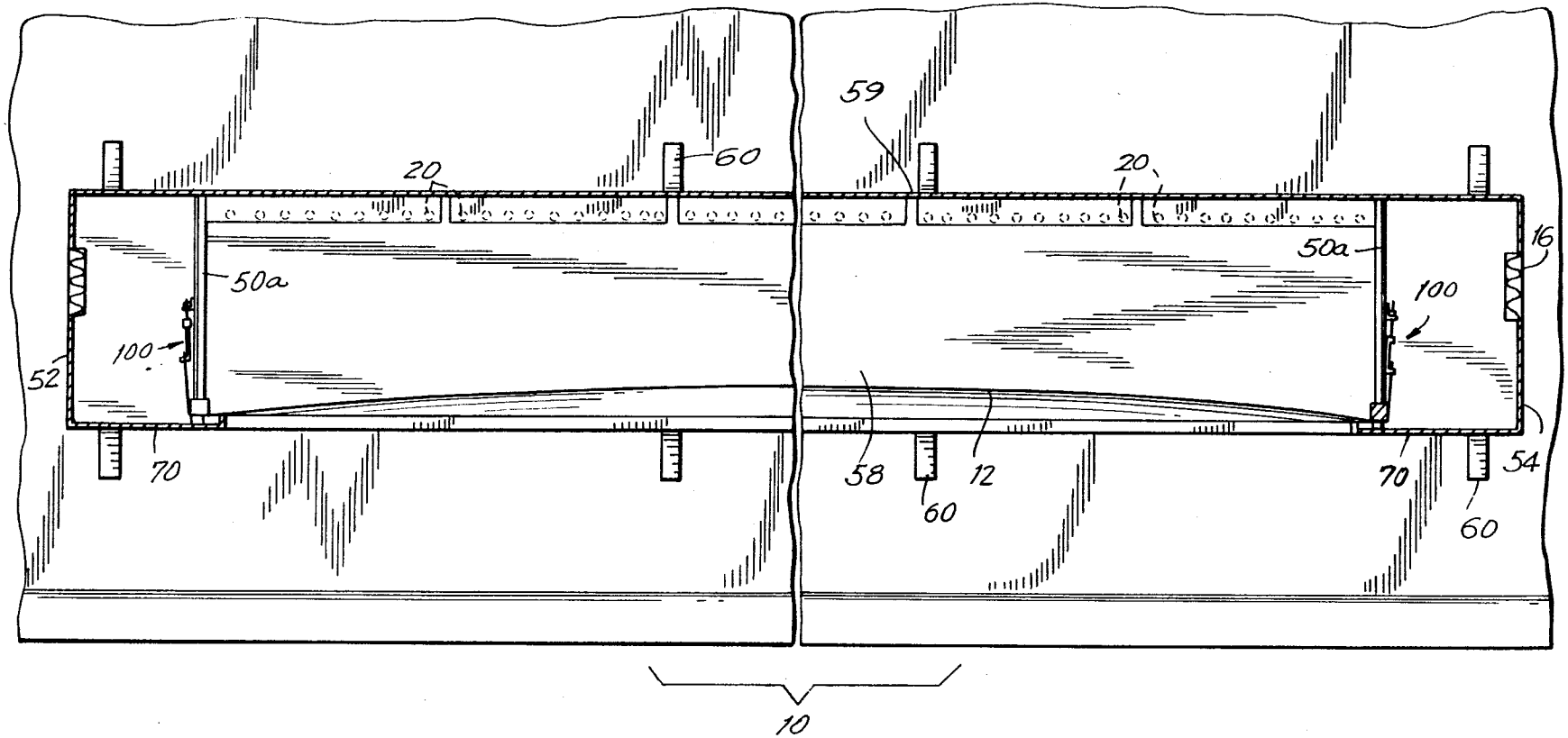
FIG. 4 is an enlarged cross-sectional view taken along lines 4—4 of FIG. 1.

Transparency 12 forms the view face of frame 50. A damper system 14 at the bottom 58 of frame 50 regulates airflow through vents 16 in the direction of arrows A. Exhaust blowers 18 supported on the top 56 of frame 50 operate in conjunction with dampers 14 and are provided for the purpose of creating a negative pressure inside frame 50 to cause transparency 12 to bow inwardly as best depicted in FIGS. 2 and 4. Lights 20 are positioned on the back wall 59 of frame 50 in order to illuminate transparency 12 from the rear thereof.

Vents 16 are openings adapted to provide for the flow of air. Dampers 14 are provided on each vent opening 16 for the purpose of regulating the size of the opening and controlling the quantity of airflow. In a preferred embodiment of the invention, filters 24 are also provided below each vent opening 16 to remove particulate matter from the air entering frame 50. The number of vent openings 16 is not critical but the number and size must be such as will allow for sufficient and uniform flow of air through frame 50 for the purpose of creating negative pressure inside frame 50.

In a preferred embodiment, each damper 14 is provided on hinge arrangement 28 such that vent 16 can be selectively opened and closed. Each hinge arrangement 28 is operated in turn by damper motor 26. Damper motor 26 may be any suitable type of motor that is conventional and well known in the art. It is noted that the type of damper and damper motor construction is not limited to the arrangement shown. It is to be understood that any suitable arrangement for providing controlled airflow through vents 16 into frame 50 can suitably be used and is within the scope of the invention.

Dampers 14 are operated in conjunction with exhaust blowers 18 for the purpose of regulating airflow within frame 50. Although a plurality of exhaust blowers 18 are shown in FIG. 1, the type and number of exhaust blowers 18 may be selected depending on the size of the frame and, as with dampers 14, any suitable construction for providing controlled airflow through frame 50 can suitably be used and is within the scope of the invention. Exhaust blowers such as those known as Peerless Electric Air Moving Equipment manufactured by Porter Electrical Division, H. K. Porter Company, Inc. are an exemplary type.

A plurality of lights or lamps 20 are secured to back wall 59 of frame 50 for the purpose of providing illumination to transparency 12. It is preferred that the transparency be as brightly illuminated as possible in order to provide a brilliant display in daylight hours. In a preferred embodiment of the invention, fluorescent lamps are used. Such lamps provide good color rendition and have a low envelope temperature. As is discussed in greater detail hereinbelow, the temperature of operation of the sign construction of the invention must be controlled.

Lamps 20 can be secured to back wall 59 of frame 50 by any suitable securing means. In a preferred embodiment, multiple rows of fluorescent lamps are used and the lamps are staggered to break up continuous dark areas between the rows of lamps.

The sign construction of the invention is especially suitable for use with a photograph provided on a film support 30 of the type shown in FIG. 6. In a preferred embodiment, film support 30 is polyester and can be of the type marketed by Kodak of Rochester, N.Y. under the tradename ESTAR®. Such a support is tough and has good properties for use in accordance with the invention. A photographic emulsion layer 32, a glossy polyester layer 34 and a matte acrylic layer 36 are provided in order on support 30. The polyester/acrylic laminate, layers 34 and 36, on the face of transparency 12 serves to protect emulsion layer 32 from environmental factors, increases the strength of transparency 12, provides protection from ultraviolet light and reduces undesirable reflection. Each section of transparency 12 can be up to a maximum of about 6 feet wide. Accordingly, multiple strips of a photograph or other mural are spliced together to form transparency 12.

A glossy polyester tape 40 followed by matte acrylic tape 42 are provided on the outside of transparency 12 adjacent matte acrylic layer 36. Finally, narrow double sided polyester tape 44 and acetate splicing tape 46 are provided along the back of transparency 12 adjacent film support 30. It is preferable for the splice to be of a cemented type as opposed to a pressure sensitive type in order to withstand the effect of cross-wise forces.

Figure 3:
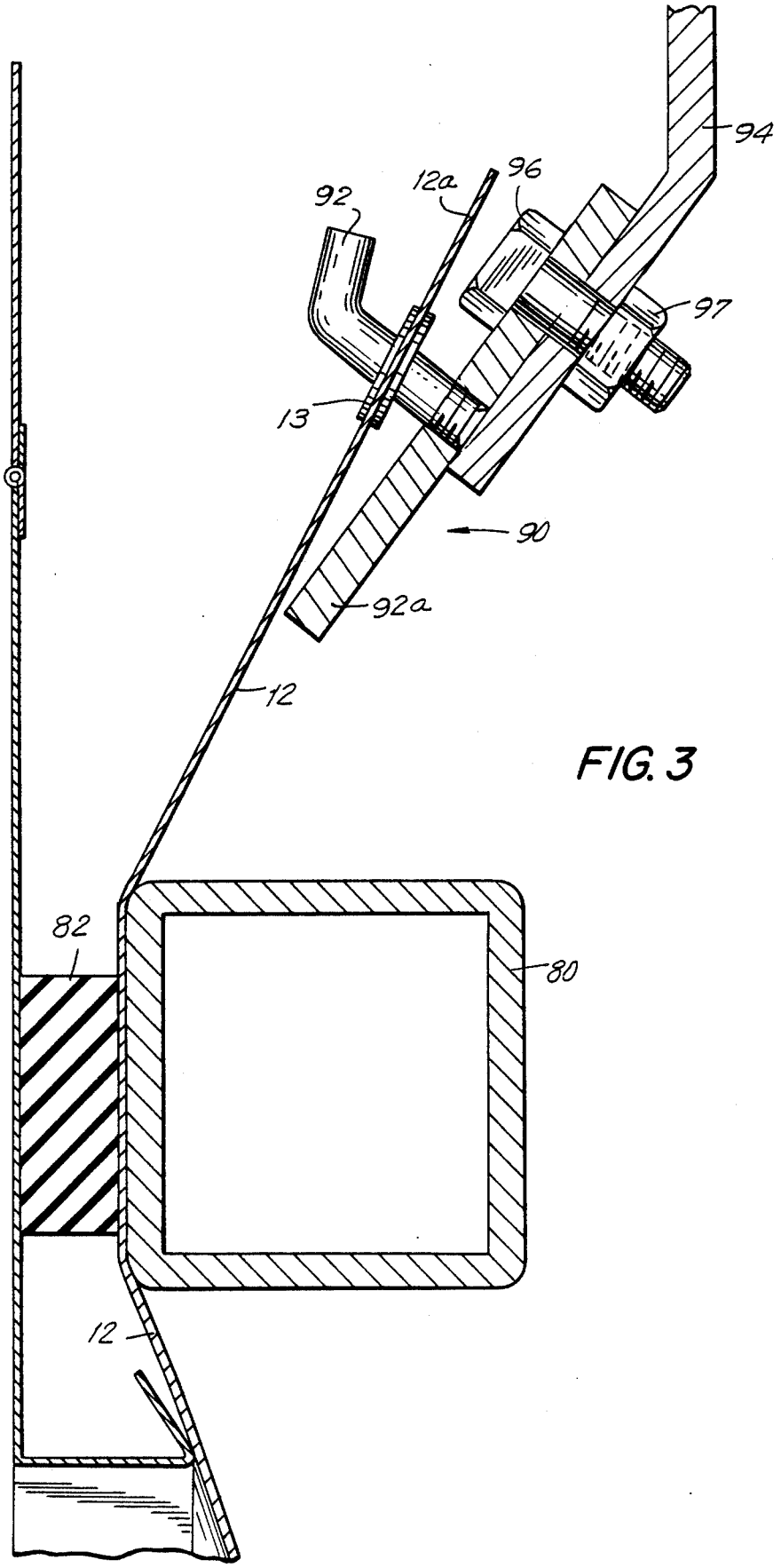
FIG. 3 is an enlarged side sectional view of a portion of the system which supports the transparency.

In a preferred embodiment, splices 38 are provided in the vertical direction of transparency 12. Once all the splices have been made and transparency 12 is ready for viewing, transparency 12 is rolled in such way that it can be secured along a side edge of frame 50 and unrolled in a horizontal direction to provide the viewing surface. It is necessary to seal transparency 12 against the front legs 70 of frame 50. As best depicted in FIGS. 3 and 5, the perimeter of transparency 12 is captured intermediate a beam 80 and an opposing gasket 82.

It is, however, known that plastic film of this type will creep when maintained under tension for an extended period of time. Accordingly, the securing means of the type shown in FIGS. 3 and 5 are preferably used to secure transparency 12. The construction 90 shown in FIG. 3 fixes the top of transparency 12 in an unmoving position and is preferably used along the top of transparency 12 adjacent exhaust blowers 18. As depicted in FIG. 3, mounting bracket 92 is secured to top **12*a* of transparency 12 through grommets 13. Mounting arm 94 is secured to top 56 of frame 50. Mounting bracket 92 includes mounting plate 92*a* which is secured to mounting arm 94 by means of bolt 96 and nut 97. A plurality of mounting devices 90 extend across top of transparency 12** to provide adequate support therefor.

Figure 5:
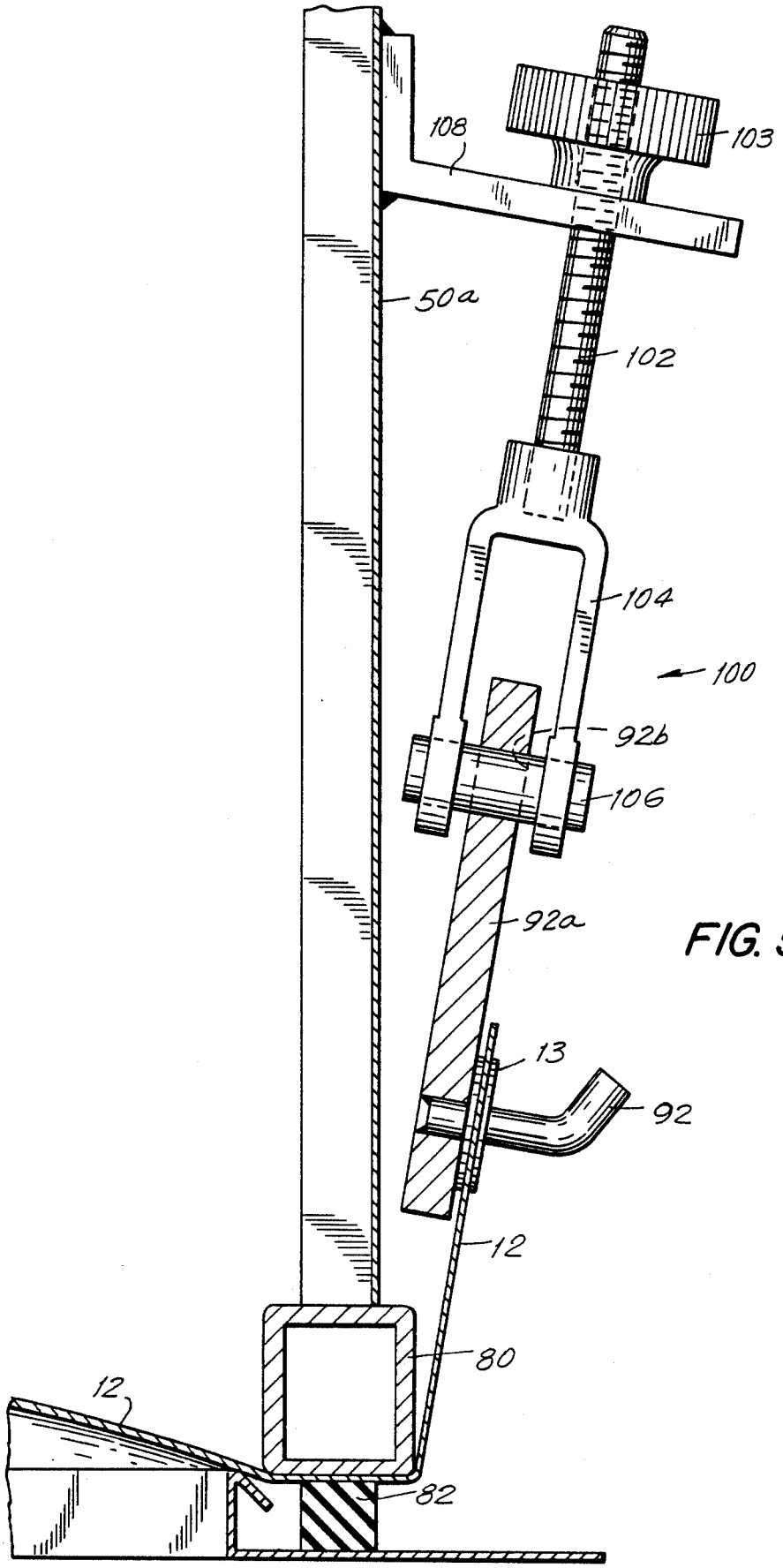
FIG. 5 is an enlarged side sectional view of another portion of the system which supports the transparency at the bottom and sides of the sign frame.

As depicted in FIG. 5, the sides and bottom of transparency 12 are supported by a plurality of adjustable mounting devices 100. Each device 100 includes mounting bracket 92 with mounting plate **92*a*. Turnscrew device 102 includes U-shaped arm 104 having rod 106 which extends through opening 92*b* in plate 92*a*. Mounting arm 108 supports turnscrew device 102 on extension support 50*a* of frame 50. As screw 103 is rotated, the tension on transparency 12** can be selectively adjusted.

Controller 120 of the type manufactured by Staefa Control System Inc, of Larchmont, N.Y. is used to regulate the pressure and temperature inside frame 50. Controller 120 is coupled to temperature probes 122, pressure probes 124 and damper motor 26. Although exhaust blowers 18 operate continuously, controller 120 is used to regulate the opening of dampers 14 and, correspondingly, the size of vents 16, for the purpose of regulating airflow through frame 50. Airflow is regulated primarily to maintain the required negative pressure, but also to regulate the temperature inside frame 50. In experimental tests conducted by the inventor, it was found that pressures of less than about 2 inches of water can desirably be used. More preferably, the pressure should be between about 0.6 and 1.5 inches of water although the optimum pressure can only be determined when the material used to construct the transparency and the environmental conditions to which the sign will be subjected are known.

It is important that the temperature inside frame 50 and of transparency 12 not become too elevated or the structural integrity of transparency 12 will be destroyed. The controller can be adjusted so as to turn off lights inside the box if the temperature becomes too elevated. In general, the temperature inside the box should not exceed 120° F. although it may be desirable to regulate the temperature by turning off banks of lights when the temperature reaches 105° F. or at selected intervals thereafter. In addition, an electronic programmable time clock is preferably provided for the purpose of sequencing the lighting in accordance with a preset schedule and making seasonal adjustments.

As can be seen, by providing a sign construction in accordance with the invention, an outdoor backlighted transparency can be provided for viewing. The outdoor backlighted transparency forms the viewing face of a specially constructed sign frame having a negative pressure selectively created inside. Accordingly, the transparency is not affected by wind or other environmental factors.

It will thus be seen that the objects set forth above, among those made apparent from the preceding description, are sufficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A sign construction for supporting a thin-walled mural comprising frame means having a open front for supporting said mural around the periphery thereof to cover the open front of said frame means and pressure means for creating a negative pressure behind said mural in said frame means to protect said mural from damage caused by wind, said pressure means including a pressure probe for monitoring the pressure inside said frame means.

2. The sign construction of claim 1, wherein said frame means further comprises support means of releasably supporting said mural in said frame means.

3. The sign construction of claim 2, wherein said support means further comprises sealing means for releasably sealing said mural in the open front of said frame means.

4. The sign construction of claim 3, wherein said sealing means includes a gasket and means for pressing the periphery of said mural against said gasket.

5. The sign construction of claim 2, wherein said support means includes fixed mounting means for releasably mounting a portion of the periphery of said mural at a fixed position.

6. The sign construction of claim 5, wherein said support means further includes adjustable mounting means provided along at least a portion of said frame means for adjusting tension of the mural.

7. The sign construction of claim 6, wherein the adjustable mounting means includes a turnscrew mechanism for selectively adjusting the tension of said mural.

8. The sign construction of claim 1, wherein said frame means is rectangular and has a top, bottom and two opposed side walls on opposite sides of said top and bottom.

9. The sign construction of claim 8, wherein said rectangular frame means further includes a back wall adjacent each of said top, bottom and two side walls.

10. The sign construction of claim 9, wherein said frame means further comprises support means.

11. The sign construction of claim 10, wherein said support means comprise fixed mounting means along said top of said frame means and adjustable mounting means along the bottom and both sides of said frame means.

12. The sign construction of claim 9, further comprising light means supported on the back wall for backlighting the mural.

13. The sign construction of claim 12, wherein said light means include a plurality of fluorescent lights.

14. The sign construction of claim 12, further comprising a temperature probe for monitoring the temperature inside said frame means.

15. The sign construction of claim 14, wherein the temperature inside said frame means is maintained at a temperature of less than about 120° F.

16. The sign construction of claim 15, wherein the temperature inside said frame means is maintained by selectively turning off said light means.

17. The sign construction of claim 1, wherein said negative pressure causes inward bowing of the mural.

18. The sign construction of claim 1, wherein the mural is a photographic transparency.

19. The sign construction of claim 18, wherein said photographic transparency is developed on sheets and wherein said sheets are spliced together to form a large photographic mural.

20. The sign construction of claim 1, wherein said pressure means includes at least one exhaust blower.

21. The sign construction of claim 1, wherein said pressure means includes at least one vent.

22. The sign construction of claim 21, wherein said at least one vent is provided with a damper for regulating the size of the vent opening.

23. The sign construction of claim 22, wherein the damper is controlled by a motor.

24. The sign construction of claim 21, wherein said at least one vent is provided with a filter adapted to filter particulate matter from incoming air.

25. The sign construction of claim 1, further comprising controller means for controlling the pressure inside said frame means.

26. The sign construction of claim 25, wherein said pressure means comprises at least one exhaust blower and at least one vent provided with a damper for regulating the size of the vent opening and wherein the pressure is maintained at a substantially constant value by regulating the at least one exhaust blower and the size of the at least one vent opening.

27. The sign construction of claim 26, wherein the damper is controlled by a motor.

28. The sign construction of claim 26, wherein said substantially constant value is betweeen about 0.6 and 1.5 inches of water.

29. The sign construction of claim 1, further comprising a temperature probe supported on said frame means for monitoring the temperature inside said frame means.

30. The sign construction of claim 29, wherein the temperature inside said mural is maintained at a temperature of less than about 120° F.

31. An outdoor sign construction adapted to support a transparency for viewing comprising:

a frame having a top wall, a bottom wall, two opposed side walls, a back wall and an open front;

said transparency being supported along each of the top, bottom and side walls and adapted to provide a viewing surface;

light means supported inside said frame for illuminating said transparency from behind;

air vent means provided at least along one of the top, bottom or side walls of said frame;

blower means provided at least along one of the top, bottom or side walls for removing air from inside said frame;

control means for controlling the operation of said vent means and said blower means to create a negative pressure inside said frame to bow said transparency inwardly; and a temperature probe supported on said frame for monitoring the temperature inside the frame.

32. The sign construction of claim 31, wherein said transparency is a photographic transparency.

33. The sign construction of claim 32, wherein said transparency is provided on a polyester film support.

34. The sign construction of claim 33, wherein a photographic emulsion layer is provided on said film support, a glossy polyester layer is provided on said emulsion layer and a matte arcylic layer is provided on said glossy polyester layer.

35. The sign construction of claim 32, wherein said transparency is provided in sections and said sections are spliced together to form a single large mural.

36. The sign construction of claim 35, wherein said sections are spliced in the vertical direction.

37. The sign construction of claim 35, wherein the splices are cement type splices.

38. The sign construction of claim 37, wherein the sections are spliced using at least polyester tape on each side of the transparency.

39. The sign construction of claim 38, wherein the splices on the side of the transparency adjacent the inside of the frame means include a narrow layer of polyester tape adjacent the transparency and a layer of acetate splicing tape adjacent the polyester tape and the transparency.

40. The sign construction of claim 38, wherein the splices on the side of the transparency that forms the viewing face include a layer of glossy polyester tape adjacent the transparency and a layer of matte acyrlic tape adjacent the glossy polyester tape.

41. A sign construction for supporting a thin-walled mural comprising frame means having an open front for supporting said mural around the peripheral thereof to cover the open front of the frame means and pressure means for creating a negative pressure behind said mural in the frame means to protect the mural from damage caused by wind and a temperature probe supported on the frame means for monitoring the temperature inside the frame means.

42. The sign construction of claim 41, wherein the temperature inside said mural is maintained at a temperature of less than about 120° F.

43. The sign construction of claim 41, wherein said frame means further includes a back wall opposite said open front and light means supported on the back wall for backlighting the mural.

44. The sign construction of claim 43, wherein the temperature inside said frame means is maintained by selectively turning off said light means.

* * * * *